US005313963A

United States Patent [19]

Rennex

[11] Patent Number: 5,313,963

[45] Date of Patent: May 24, 1994

[54] HAIRPIECE BASE

[76] Inventor: Brian G. Rennex, 431 Muddy Branch Rd., #101, Gaithersburg, Md. 20878

[21] Appl. No.: 846,243

[22] Filed: Feb. 13, 1992

[51] Int. Cl.[5] ..... A41G 5/00

[52] U.S. Cl. ..... 132/54; 132/53

[58] Field of Search ..... 132/53, 54, 56, 201

[56] References Cited

U.S. PATENT DOCUMENTS

| | | | |
|---|---|---|---|
| 1,845,380 | 2/1932 | Westmore | 132/53 |
| 3,472,246 | 10/1969 | Ostrom | 132/53 |
| 3,722,517 | 3/1973 | Molinako | 132/53 |
| 3,896,821 | 7/1975 | Clark | 132/201 |
| 3,970,092 | 7/1976 | Nelson | 132/53 |
| 3,971,392 | 7/1976 | Brehmer | 132/201 |
| 4,214,033 | 7/1980 | Clifton et al. | 132/53 |
| 4,386,619 | 6/1983 | Williams | 132/53 |
| 4,606,359 | 8/1986 | Palumbo et al. | 132/53 |
| 4,799,502 | 1/1989 | Kobayashi et al. | 132/53 |
| 5,044,382 | 9/1991 | Ando et al. | 132/54 |

FOREIGN PATENT DOCUMENTS

| | | | |
|---|---|---|---|
| 1814369 | 8/1970 | Fed. Rep. of Germany | 132/53 |

*Primary Examiner*—Gene Mancene
*Assistant Examiner*—Frank A. LaViola

[57] ABSTRACT

The hairpiece base invention relates to hairpieces and in particular to a improved base which renders the hair piece virtually undetectable to sight and to touch. The invention comprises a mesh and a mesh binder. The mesh affords structural strength in the lateral plane, and it serves as an anchor for artificial hairs. The mesh binder fills the region between the mesh strands, and its thickness is approximately equal to the diameter of the mesh strands. At the perimeter of the base, the mesh binder edge may be tapered in thickness.

16 Claims, 4 Drawing Sheets

HAIRPIECE BASE

BACKGROUND OF THE INVENTION

This invention relates to hairpieces and in particular to an base which renders the hairpiece virtually undetectable to sight and to touch. The prior art bases consist typically of a coarse mesh, in the approximate shape of a cap, to which artificial hairs are tied. Since mesh strands do not adhere well to the scalp, a base liner is sewn over a portion of the base for the purpose of adhering the base to the scalp. This base liner is typically made of a thin, hard synthetic material. It may cover the entire base, or it may cover only a strip along the base perimeter. Some bases of the prior art utilize a very fine strand mesh.

The disadvantages of these prior bases are the following. The coarse mesh is hard, and it scratches the scalp. The base liner is hard, and its edges scratch the scalp. The base liner is impermeable to moisture and air. The edge of these bases require a thick thicket of hair to hide the base edge. This thicket gives an unnatural look, and it does not cover the base edge adequately. The mesh cannot be adhered directly to the scalp. The mesh and base liner are not skin-colored. The mesh edge, at the perimeter of the base, has sharp, hard strand ends which irritate the scalp and which are very detectable to touch and sight.

Usually, the solution for a natural front hairline has been the lace front hairpiece as disclosed in U.S. Pat. No. 2,814,301. This solution has the disadvantage that it is difficult to adhere the lace base to the scalp. A liquid adhesive must be used, which requires a inconveniently long drying time and an irritating solvent. Also, the lace base extends out in front of the hairline and must be covered with make-up. Finally, the lace base is fragile.

There are two notable attempts in the recent prior art to achieve a natural hairline. The invention of U.S. Pat. No. 4,509,539 of Alfieri utilizes a mesh strengthened by ultrasonic welding. This mesh is purported to conform to the contour of the scalp, thereby eliminating the need for liquid adhesive. It is doubtful that this hairpiece would be undetectable under close visual inspection because its mesh extends slightly out in front of the hairline. Even if that were not the case, the density of hairs at the very front edge of the hairpiece would have to be high, and this would create the impression of a hard or severe front hairline. Also, it is likely that a mesh that is sufficiently stiff to press against the scalp would cause irritation to that same scalp. A final difficulty is that this front edge would be tactually noticeable; in addition, a strong wind, a hand, a strong water current, or some other object brushing against it would peel it back.

The invention of U.S. Pat. No. 4,799,502 of Kobayashi overcomes some of these difficulties. It features a zigzag shape for a mesh-formed front hairline, an idea that has been used by numerous wig makers over the years and that is not original to his patent. This mesh must also ultrasonically welded for added strength and stiffness. What may be original is a zigzag stitching just inside the front border of the mesh, of a nylon filament which is half as fine as that forming the mesh. This filament is purported to add strength to the front portion and to prevent it from loosening. This is misleading in that the only portion of the mesh strengthened by this stitching is that portion which is actually stitched. The very front portion, of a width range between 3 and 15 mm, is not strengthened by this stitching. Also, this stitching is a source of discomfort. Accordingly, invention of Kobayashi does not solve the aforementioned problems of the front edge peeling up or of tactile detectability.

Next, consider whether his invention gives a completely natural hairline appearance. It purports to overcome the hard front problem associated with a linear and close alignment of artificial hairs, by planting the hairs at appropriate intervals along the zigzag boundary. It would seem that this design would be an improvement over its prior art in this regard, but it would also seem that difficulties remain. There is nothing to prevent hairs tied at the front vertex from migrating rearward and sideward, thereby leaving exposed the very front portion near the vertex. Also, the sharp triangular geometry of the vertex makes it impossible to place a plurality of hairs where they are most needed to cover the mesh. All of the just-discussed disadvantages of both his invention and the remaining prior art will be addressed by the present invention.

SUMMARY OF THE INVENTION

The hairpiece base invention relates to hairpieces and in particular to a improved base which renders the hair piece virtually undetectable to sight and to touch. The invention comprises a mesh and a mesh binder. The mesh affords structural strength in the lateral plane, and it serves as an anchor for artificial hairs. The mesh binder fills the region between the mesh strands, and its thickness is approximately equal to the diameter of the mesh strands. At the perimeter of the base, the mesh binder edge may be tapered in thickness. This mesh-/binder base can be utilized as a perimeter strip or as a hair-part strip; it can be manufactured with breathing holes; and it can be skin-colored.

The mesh/binder base features the following advantages. The mesh makes the base strong and durable. The mesh binder is adherable, so tape can be utilized for convenient application and removal; it protects the mesh, improving durability; it is soft, making the base and its edges non-irritating to the scalp; and it prevents artificial hairs from migrating along the mesh strands. The skin color and the edge taper make it undetectable both tactually and visually. Other options for visual undetectability include a zigzag front edge or a protective strip of surgically implanted hairs immediately in front of the hairline front edge. For cheaper manufacture, a composite structure can be used, featuring various base constructions for various parts of the hairpiece.

BRIEF DESCRIPTION OF THE DRAWINGS

FIG. 1 also shows breathing holes in the mesh/elastomer base, according to the invention in the second embodiment.

DETAILED DESCRIPTION

Figure 1:
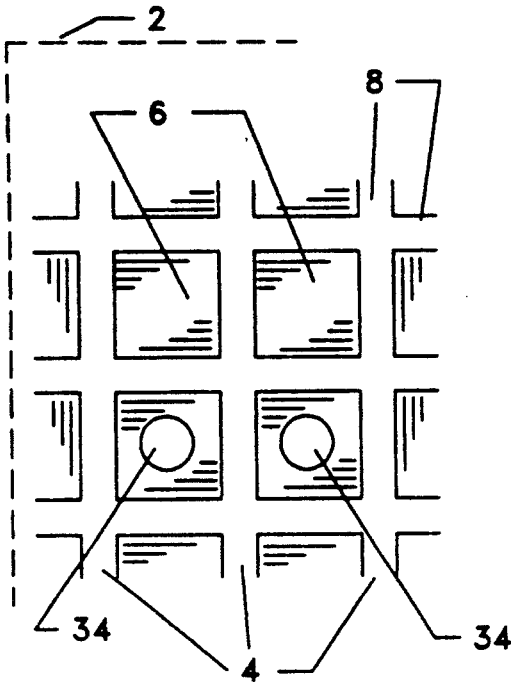
FIG. 1 is a top view of a typical portion of the mesh-/elastomer base, according to the invention in the first embodiment.
Figure 2:
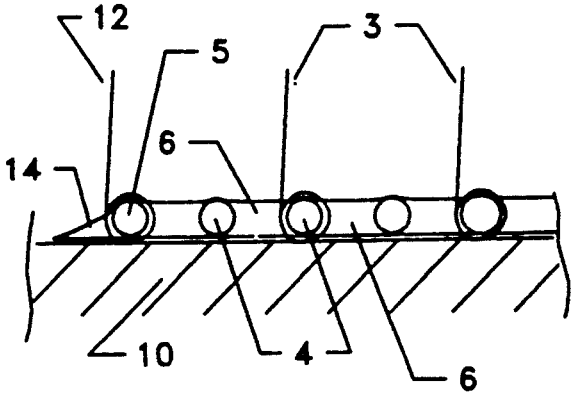
FIG. 2 is a cross-sectional side view of the mesh/elastomer base, according to the invention in the first embodiment.

FIGS. 1 and 2 show a top view and a side view of mesh/elastomer base 2, according to the invention in the first embodiment. Mesh strands 4 form mesh 8 in the plane of mesh/elastomer base 2. Mesh binder regions 6 fill the intervening space in this plane, and mesh binder regions 6 surround and adhere to mesh strands 4. Tapered edge 14, which is optional, causes a smooth transition between scalp 10 and mesh/elastomer base 2. That is, this transition does not present an abrupt step up. It should be understood that the actual appearance of mesh/elastomer base 2 is of a flat, continuous surface, and that mesh strands 4 can not be visually or tactually detected. That is, mesh strands 4 and mesh binder regions 6 are shown as visually distinct simply for presentation. Note that mesh binder regions 6 may have breathing holes 34 in their center areas.

Figure 3:
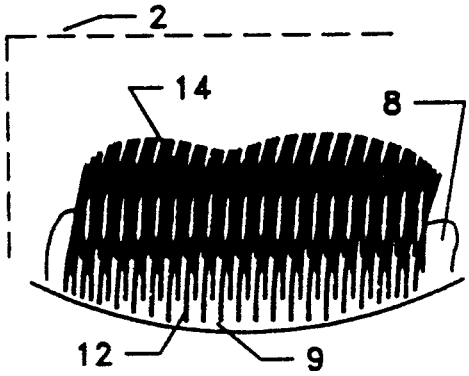
FIG. 3 shows a front view of an edge region of the mesh/elastomer base, according to the invention in the first embodiment.

Looking at FIG. 3, artificial hairs 3 are tied to mesh strands 4 in such a way that front base edge 9, which may consist of tapered edge 14, does not present a hard or severe line of thickly congregated hairs. In other words, the many first strands 12 do not block vision in past the hairline. FIG. 3 shows a front view of an edge region of mesh/elastomer base 2, according to the invention in the first embodiment. It shows that a natural hairline can be achieved by adding artificial hairs 3 in such a manner that one can see a little ways into the thicket of hairs from the front edge. When front base edge 9 of mesh/elastomer base 2 comprises skin-colored taper edge 14, it is not necessary to have a sharp edge of densely packed artificial hairs 3 to render base edge almost completely undetectable to sight. Make-up can be used to completely camouflage tapered edge 14, or cover hairs 17 which are oriented to extend slightly forward and substantially to the side as shown in FIG. 4 can serve to adequately cover tapered edge 14.

Figure 4:
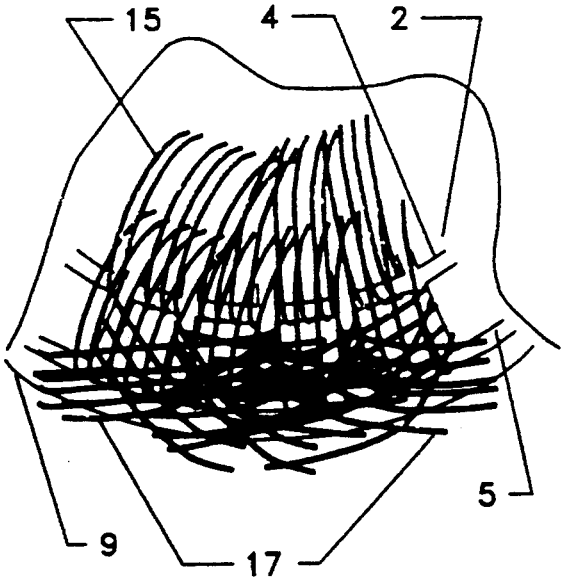
FIG. 4 is a top view showing camouflage means for the mesh/elastomer base, according to the invention in the first embodiment.

FIG. 4 is a top view of mesh/elastomer base 2, according to the invention in the first embodiment. Cover hairs 17 are directed in a sideswept direction for optimal coverage of tapered edge 14 or of front strand 5. It should be understood that front edge 9 might alternatively be formed by front strand 5, rather than tapered edge 14. One might utilize strategies that are extensions of that featuring a sideswept direction of cover hairs 17. For example, cover hairs 17 might be cross-matted for better coverage, wherein some would be directed to one side, some to another side, and some to the front.

Figure 5:
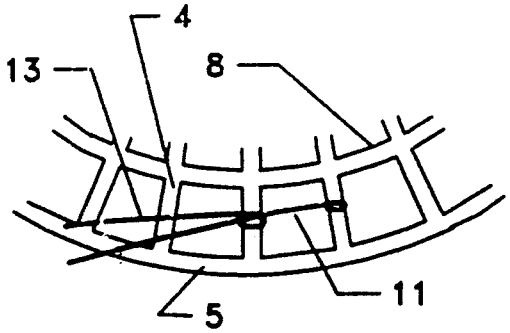
FIG. 5 is a top view showing camouflage means for the mesh/elastomer base, according to the invention in the first embodiment.

FIG. 5 is a top view of mesh/elastomer base 2, according to the invention in the first embodiment; it shows a method to ensure a precisely defined sideswept direction of first cover hair 11, by virtue of it passing through the knot of second cover hair 13. A related feature due to the use of mesh binder regions 6 is that artificial hairs 3, such as first strand 11, are prevented from migrating along mesh strands 4 by these mesh binder regions 6.

Figure 6:
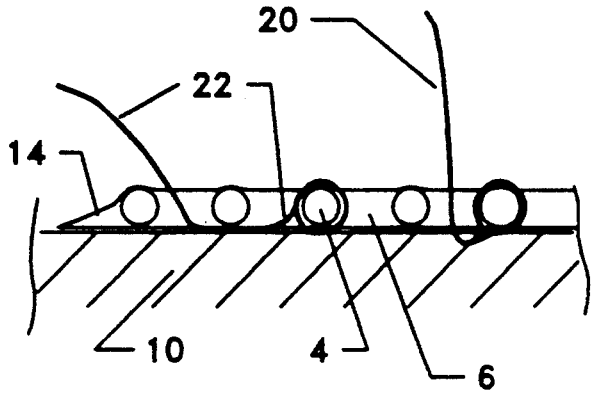
FIG. 6 is a side view showing hairs pricked through the binder regions of the mesh/elastomer base, according to the invention in the first embodiment.

FIG. 6 is a front view of mesh/elastomer base 2, according to the invention in the first embodiment; it shows another method to ensure a precise location and direction of artificial hairs 3 of FIG. 2. For example, first pricked hair 20 can be knotted to one of mesh strands 4 in such a manner that it initially protrudes out of the bottom of mesh/elastomer base 2; it is then pricked through mesh binder region 6 at an arbitrary location. In the case of second pricked hair 22, it passes beneath a mesh strand before it protrudes from an adjacent mesh binder region 6. This added versatility, of not being restricted to mesh strand locations with regard to hair location and direction, makes possible the creation of a more natural hairline in a quick and cost-effective manner.

Figure 7A:
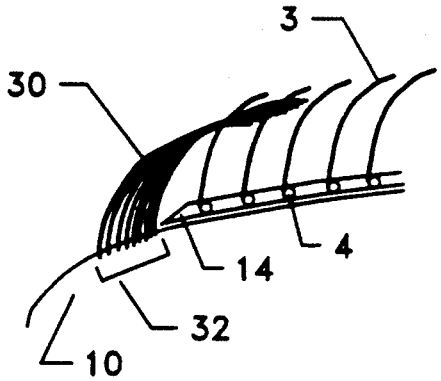
FIG. 7 shows a side view and a top view of the mesh-/elastomer base and a strip of hairs implanted into the scalp for camouflage, according to the invention in the first embodiment.
Figure 7B:
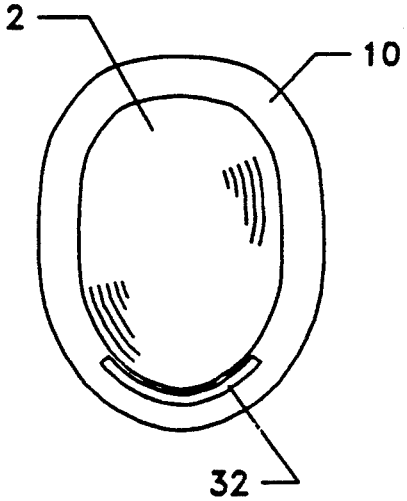

FIG. 7 is a side view and a top view of mesh/elastomer base 2 and implanted strip 32, according to the invention in the first embodiment, showing another strategy for camouflage of front base edge 9 using implanted hairs 30 which have been surgically implanted into the scalp along implanted strip 32. Implanted hairs 30 are undetectable since they emanate directly from scalp 10. Implanted strip 32 need be only thick enough to camouflage front base edge 93 this means that a much smaller area must be covered than if the entire bald region of the scalp were covered. Thus, the cost of the treatment for implanted strip 32 would be considerably reduced over that of a full scalp treatment. Mesh/elastomer base 2 could be attached to scalp 10 either by adhesive tape or glue or by one of several hair weave techniques commonly utilized to attach a hairpiece to existing hair.

Figure 8:
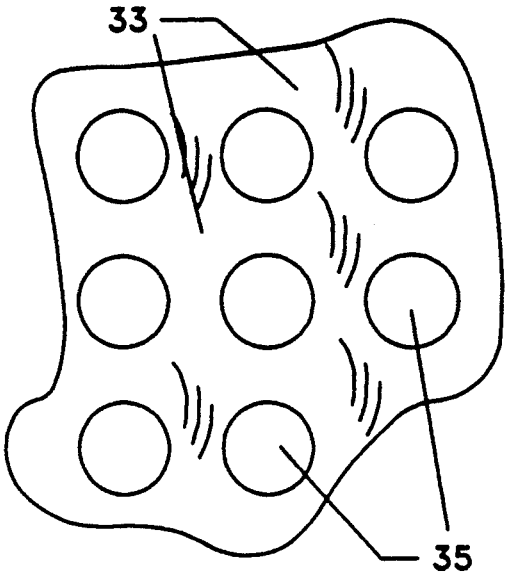
FIG. 8 is a top view of a double-sided tape with holes, to be used with a mesh/elastomer base with breathing holes, as shown in FIG. 1 according to the invention in the second embodiment.

FIG. 8 shows a top view of a portion of double-sided tape 33 which has been made to have tape holes 35. To permit passage of moisture from scalp 10 as shown in FIG. 3, tape holes 35 would be aligned with breathing holes 34 (shown in FIG.), when using double-sided tape 33 to adhere mesh/elastomer base 2 to scalp 10.

Figure 9A:
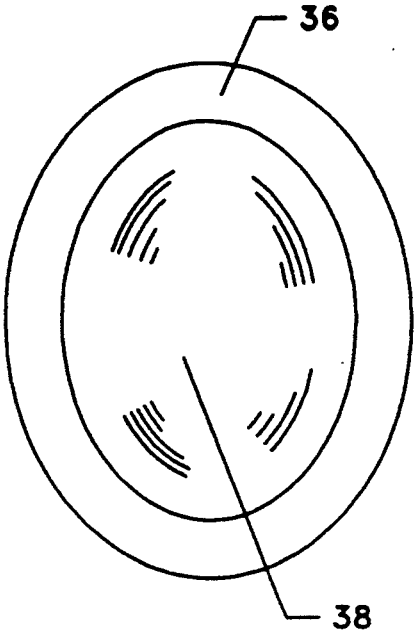
FIGS. 9 and 10 are top views showing various composite structures of the mesh/elastomer base, according to the invention in the third embodiment.
Figure 9B:
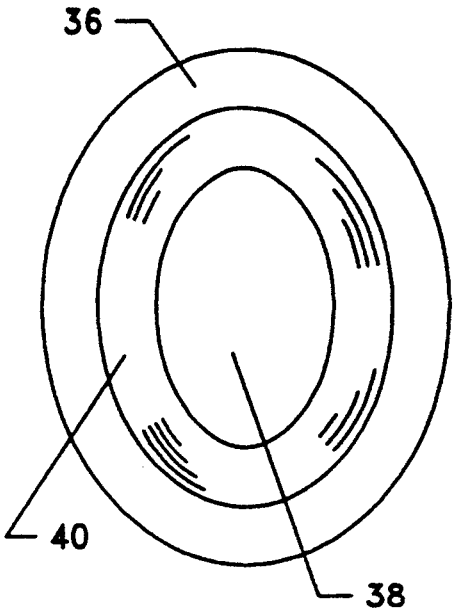
Figure 10:
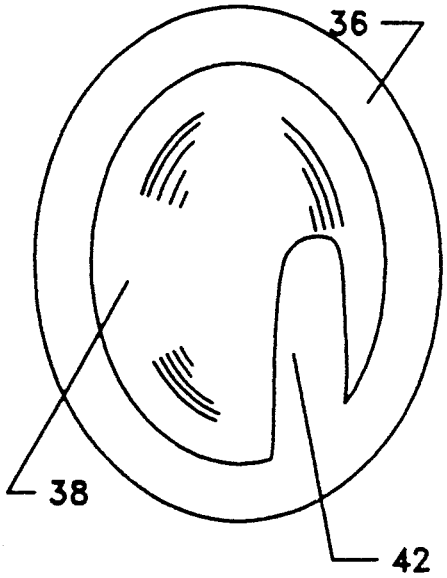

FIGS. 9 and 10 are top views showing examples of some of the possible composite structures which might incorporate mesh/elastomer base 2, according to the invention in the third embodiment. It should be understood that the three-dimensional shape of mesh/elastomer base 2 could be that of a skull-cap or that of a portion of a skull cap FIG. 9*a* shows a perimeter strip 36 consisting of mesh/elastomer base 2 of the first embodiment, and it shows a center region 38 consisting of a mesh construction typical of prior-art bases. Alternatively, FIG. 9*b* shows a perimeter strip 36 consisting of mesh/elastomer base 2 of the first embodiment, a second perimeter strip 40 consisting of mesh/elastomer base 2 of the second embodiment, featuring breathing holes 34, and center region 38 consisting of a mesh construction typical of prior-art bases. Or, FIG. 10 shows a composite structure identical to that of FIG. 9*a* except that it includes parting strip 42 of a construction according to the second embodiment. Here, perimeter strip 36 might consist of mesh/elastomer base 2 of the first embodiment, and center region 38 might consist of a mesh construction typical of prior-art bases.

Figure 11:
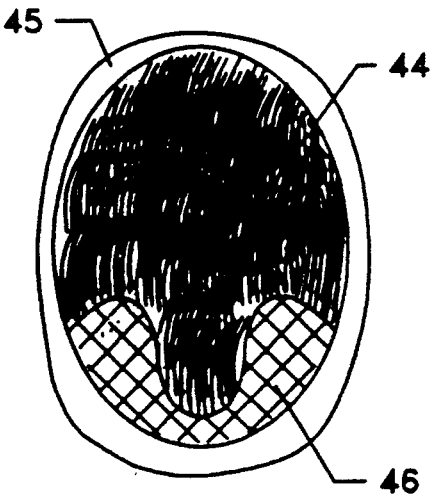
FIG. 11 is a top view of a variation of mesh/elastomer base with a hairline extension strip, according to the invention in the fourth embodiment.

FIG. 11 shows a top view of hairline extension strip 46, according to the invention in the fourth embodiment. Hairline extension strip 46 is used to extend the boundary of existing hair region 44. This embodiment is convenient, since mesh/elastomer base 2 is easily adhered to scalp 10 with double-sided adhesive tape.

Figure 12:
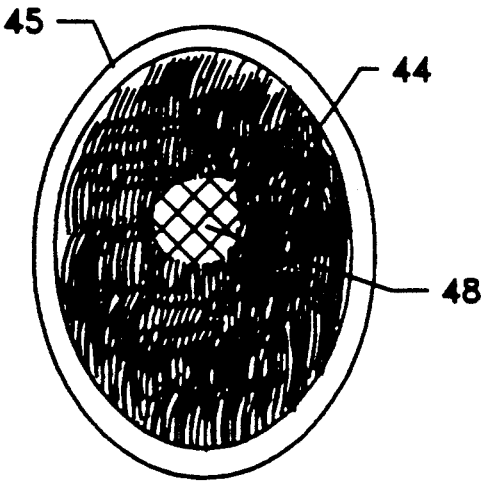
FIG. 12 is a top view of a variation of mesh/elastomer base with a hair patch, according to the invention in the fifth embodiment.

FIG. 12 shows a top view of hair patch 48, according to the invention in the fifth embodiment. Hair patch 48 is used to fill a bald area in existing hair region 44. Again, this embodiment is convenient, since mesh/elastomer base 2 is easily adhered to scalp 10 with double-sided adhesive tape.

It should be understood that FIGS. 9–12 are a partial representation of the range of possible composite structures of mesh/elastomer base 2, which could comprise any configuration of base types in any of a wide variety of component shapes.

Figure 13:
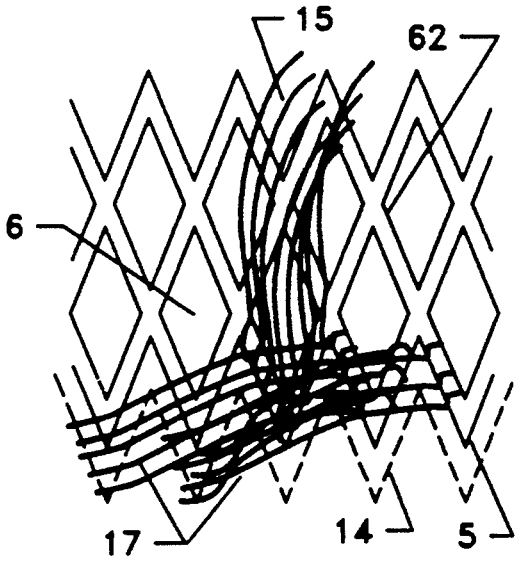
FIG. 13 is a top view of the mesh/elastomer base with a zigzag front line, according to the invention in the sixth embodiment.

FIG. 13 is a top view of mesh/elastomer base 2, according to the invention in the sixth embodiment. This embodiment is similar to that of FIGS. 4 and 5 except that diamond-oriented mesh strands are oriented differently, so that they form a zigzag pattern at front base edge 9, which can alternatively be formed by tapered edge 14 or by front strand 5. Vertical hairs 15 can be bunched and maintained at the front vertex portion of front strand 5, by virtue of the restraint of mesh binder region 6. FIG. 13 shows that this zigzag orientation lends itself to convenient crossmatting of cover hairs 17.

Figure 14:
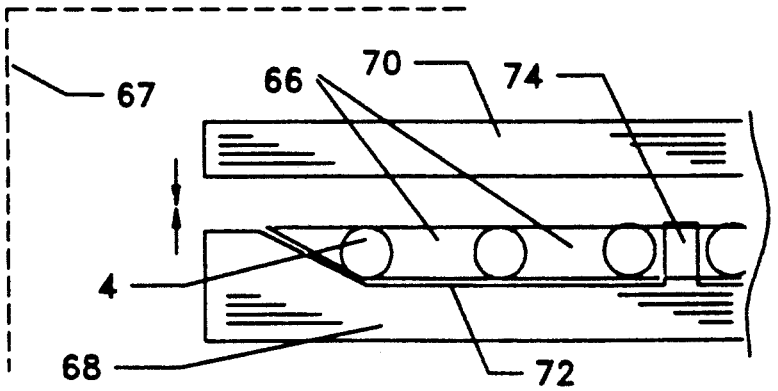
FIG. 14 is a side view of a mold used to manufacture the mesh/elastomer base, according to the invention in the seventh embodiment.

FIG. 14 is a side view of mold 67 used to manufacture the mesh/elastomer base, according to the invention in the seventh embodiment. Mesh 8 comprised of mesh strands 6 is placed in mold cavity 72, contained in bottom mold 68. Preset binder material 66 is poured or injected into mold cavity 72, and top mold is fit and pressed against bottom mold 68, forcing out any extraneous amount of preset binder material 66. After setting, the result is a strip or a sheet in the configuration of mesh/elastomer base 2. The composition of preset binder material could be any moldable material such as latex, silicone or urethane. To achieve breathing holes 34 as shown in FIG. 1, bottom mold 68 would include breathing hole posts 74.

The above description shall not be construed as limiting the ways in which this invention may be practiced but shall be inclusive of many other variations that do not depart from the broad interest and intent of the invention.

Having thus described the invention, what is claimed as new and desired to be secured by Letters Patent is:

1. A hairpiece comprising a base to which hairs are affixed and an attachment means for affixing the base to the scalp, wherein said base comprises a mesh and elastomer composite section with mesh strands interwoven among each other, thereby defining voids between said strands and binder regions occupying at least a portion of said voids, wherein the thickness of said binder regions is uniformly and substantially equal to or slightly greater than the thickness of the mesh strands thereby minimizing the overall thickness of the base.

2. The hairpiece of claim 1, wherein said base comprises:

a center region, a perimeter region of said mesh and elastomer composite section, wherein said perimeter region surrounds at least a part of said center region, a perimeter edge forming the outermost edge of said perimeter region.

3. The hairpiece of claim 2, wherein said perimeter region comprises a camouflage means which limits visual detection of said perimeter edge.

4. The hairpiece of claim 3, wherein said camouflage means comprises cover hairs attached to said mesh strands in said perimeter region whereby said perimeter edge is substantially covered from view by said cover hairs.

5. The hairpiece of claim 4, wherein said cover hairs are tied to said mesh strands and wherein said cover hairs protrude through said binder region.

6. The hairpiece of claim 4, wherein at least some of said cover hairs are tied to a plurality of said mesh strands.

7. The hairpiece of claim 2, wherein said perimeter edge comprises a tapered edge; wherein said tapered edge is composed of said binder regions only.

8. The hairpiece of claim 2, wherein said perimeter edge is formed in a zigzag pattern.

9. The hairpiece of claim 2, wherein said center region comprises a mesh.

10. The hairpiece of claim 2, wherein said center region comprises said mesh and elastomer composite section.

11. The hairpiece of claim 2, wherein said center region comprises a contoured section of said mesh and elastomer composite section.

12. The hairpiece of claim 2, wherein said perimeter region comprises an outer perimeter region of said mesh and elastomer composite section and an inner perimeter region of said mesh and elastomer composite section, wherein said binder regions of said inner perimeter region contain binder voids.

13. The hairpiece of claim 1, wherein said binder regions contain binder voids.

14. The hairpiece of claim 1, wherein said composite section comprises a patch positionable on a bald spot.

15. The hairpiece of claim 1, wherein said mesh and elastomer composite section comprises a contoured section positionable on the front side of the natural hairline of said scalp.

16. The hairpiece of claim 1, wherein said attachment means comprises a double-sided tape with voids therein.

* * * * *